US005811943A

United States Patent [19]

Mishin et al.

[11] Patent Number: 5,811,943

[45] Date of Patent: Sep. 22, 1998

[54] HOLLOW-BEAM MICROWAVE LINEAR ACCELERATOR

[75] Inventors: Andrey Mishin, San Jose; Russell G. Schonberg, Los Altos Hills, both of Calif.

[73] Assignee: Schonberg Research Corporation, Santa Clara, Calif.

[21] Appl. No.: 717,859

[22] Filed: Sep. 23, 1996

[51] Int. Cl.[6] ..... H05H 9/04

[52] U.S. Cl. ..... 315/505; 250/396 R; 315/5.14

[58] Field of Search ..... 315/503, 505, 315/5.14; 250/396 R, 398, 492.3; 372/2

[56] References Cited

U.S. PATENT DOCUMENTS

| | | | |
|---|---|---|---|
| 4,323,857 | 4/1982 | Brau et al. | 372/2 |
| 4,479,218 | 10/1984 | Brau et al. | 372/2 |
| 4,733,131 | 3/1988 | Tran et al. | 315/5.14 |
| 4,827,192 | 5/1989 | Tran et at. | 315/5.39 |
| 4,988,919 | 1/1991 | Tanabe et al. | 315/5.41 |

OTHER PUBLICATIONS

G.A. Westenskow et al., Design of a Relativistic Klystron Two–Beam Accelerator Prototype, IEEE, 1996, pp. 737–739 (no month).

G. Carron & L. Thorndahl, Progress with the CLIC Transfer Structures (CTS), Proceedings of the Fourth European Particle Acc. Conf., 1994, pp. 2167–2169. (no month).

C.J. Karzmark, Advances in Linear Accelerator Design for Radiotherapy, Med. Phys. 11 (2), Mar./Apr. 1984, pp. 105–128.

*Primary Examiner*—Sandra L. O'Shea
*Assistant Examiner*—Michael Day
*Attorney, Agent, or Firm*—Stanley Z. Cole; William McClellan

[57] ABSTRACT

A linear accelerator for charged particles includes a plurality of accelerating stages in a linear arrangement along a central axis. Each accelerating stage has at least one passageway radially spaced from the central axis for transmitting a beam of charged particles. Electromagnetic wave energy is coupled to the accelerating stages to produce an accelerating electric field in a region of the passageway of each of the accelerating stages. Coupling circuits couple the electromagnetic wave energy between adjacent accelerating stages. Each accelerating stage may be configured as an annular accelerating cavity or as two or more accelerating cavities disposed around the central axis. The passageway may be configured as two or more discrete apertures or a single annular aperture. Beam bending devices may be used to direct the charged particle beam through the accelerator two or more times. The linear accelerator produces a high current, high energy charged particle beam.

17 Claims, 7 Drawing Sheets

HOLLOW-BEAM MICROWAVE LINEAR ACCELERATOR

FIELD OF THE INVENTION

This invention relates to charged particle beam devices and, more particularly, to a microwave accelerator and/or amplifier wherein multiple discrete apertures are, or a continuous annular aperture is, spaced from the central axis of the microwave structure. The disclosed microwave structure permits the following: higher current charged particle beams to be accelerated to high energy; higher energy, achieved by using the same length used for lower energy by recirculating the particle beam through various apertures of the structure; use of the same structure in combination as a microwave amplifier and linear accelerator, when high current beams are generating fields in the cavities and a low current beam is accelerated to a high energy; use of the structure in a microwave amplification mode as, for example, a klystron pulsed or CW-type operation.

BACKGROUND OF THE INVENTION

Charged particle beam devices are used in a variety of applications, including high energy radiography, computer tomography, intraoperative surgery, neurosurgery, radiation therapy, geophysical logging, sterilization, space technology and other applications. Conventional microwave linear accelerators (the term "accelerator" as used in this invention is intended to encompass both acceleration and amplification since, as is known in this art, the modes of operation as will be discussed herein are similar and the disclosure of one is also the disclosure of the other) include multiple acceleration cavities 10 in a linear structure, as shown in FIGS. 1 and 2. The accelerator includes a central passageway 12 through the acceleration cavities. By appropriate phasing of the microwave energy in each cavity, charged particles can be progressively accelerated as they pass through the accelerator. The microwave energy is coupled between accelerating cavities by coupling cavities 14, 16, which may be located on the axis of the charged particle beam (FIG. 2) or off axis (FIG. 1).

A wide variety of linear accelerator structures are known in the prior art, all of which involve a single, centrally located passageway for the charged particle beam. Both standing wave and traveling wave accelerator structures are known. Linear accelerators are discussed generally by C. J. Karzmark in *Medical Physics*, Vol. 11, No. 2, March/April 1984, pps. 105–128. Linear accelerators typically include a buncher section or region between the charged particle beam source and the rest of the accelerator structure. The buncher converts a continuous charged particle beam into a series of particle bunches. By appropriate phasing of the bunches with respect to the microwave field, the particles are uniformly accelerated.

Typically, the charged particle beam is accelerated along the axis of the accelerator structure using a transverse magnetic ($TM_{01}$) mode with a single field variation in the radial direction. The beam is accelerated through an axial aperture having a predetermined diameter. To achieve a higher energy beam, the aperture size may be reduced, thereby increasing the shunt impedance and the accelerated beam energy. However, by reducing the aperture size, the transferable beam current is reduced. In particular, the space charge effect and the wake field effect cause the beam to diverge radially and to debunch along the axis. Since only a portion of the diverging beam passes through the axial aperture, the beam current is reduced as the beam passes through the accelerator. For these reasons, it has been difficult to accelerate high current particle beams in accelerator structures especially at higher frequencies.

SUMMARY OF THE INVENTION

According to the present invention, a linear accelerator for charged particles comprises a plurality of accelerating cavities (cavities is a word used interchangeably herein with cells and/or accelerating stages) disposed in a linear arrangement along a central axis, each accelerating stage or cavity having at least one passageway radially spaced from the central axis for transmitting a beam of charged particles through the accelerating stage in energy exchanging relation with an electromagnetic wave in the accelerating stage, means for coupling electromagnetic wave energy to the accelerating stages to produce an accelerating electric field in a region of the passageway of each of the accelerating cells and coupling circuits for coupling the electromagnetic wave energy between adjacent accelerating cavities.

Each of the accelerating stages may comprise an annular accelerating cavity disposed around the central axis. Alternatively, each of the accelerating stages may comprise two or more accelerating cavities disposed around the central axis in a parallel arrangement. The passageway may comprise two or more spaced-apart apertures at a distance R from the central axis of the accelerating stages, and the beam of charged particles comprise two or more discrete beams. When an annular accelerating cavity is utilized, the passageway may comprise a continuous annular aperture. The beam of charged particles in this embodiment may comprise a substantially uniform hollow beam or discrete beams directed through the annular aperture.

The accelerating stages may be configured for producing a $TMO_{020}$ mode having a maximum electric field strength at the radius of the beam passageway. In a preferred embodiment, the coupling circuits are located on the central axis between adjacent ones of the accelerating stages.

When a single charged particle beam is required, the accelerator can include means for focusing the multiple beams or the hollow beam at a desired location. In other applications, the passageway can be configured to produce a desired spatial distribution of the output beam.

According to another aspect of the invention, the charged particle beam may make at least two passes through the accelerator. A beam bending device positioned adjacent to one end of the passageway of the accelerator reverses the beam exiting the passageway of the accelerator and directs it through the passageway a second time along a different path. One or more beam bending devices can be used to produce two or more passes through the accelerator. The beam bending device may comprise a bending magnet.

According to a further aspect of the invention, the linear accelerator shown and described herein is utilized in a beam excited configuration. The linear accelerator includes a plurality of accelerating stages disposed in a linear arrangement along a central axis and coupling circuits for coupling electromagnetic wave energy between adjacent ones of the accelerating stages. Each accelerating stage has a first passageway radially spaced from the central axis for transmitting a low energy beam of charged particles through the accelerating stage. Each accelerating stage further includes a second passage for transmitting a high energy beam of charged particles. The accelerator further includes means for coupling power, generally by a low energy beam of charged particles through the first passageway of the accelerator stages for producing an accelerating electric field in a region of the second passageway of each of the accelerating stages for accelerating the high energy beam of charged particles.

BRIEF DESCRIPTION OF THE DRAWINGS

For a better understanding of the present invention, reference is made to the accompanying drawings, which are incorporated herein by reference and in which.

DETAILED DESCRIPTION

The present invention provides a compact accelerator structure for generating high current, high energy charged particle beams. Rather than producing a single on-axis beam of charged particles, the accelerator of the present invention produces two or more discrete beams or a single hollow beam at a prescribed radius from the central axis of the accelerator structure. The accelerator includes two or more accelerating stages in a linear arrangement along a central axis. Each accelerating stage includes an accelerating cavity or an arrangement of accelerating cavities. Each accelerating cavity could be designed to produce maximum axial electric fields at the radius of the discrete beams or the hollow beam.

Figures 3A, 3B, 3C:
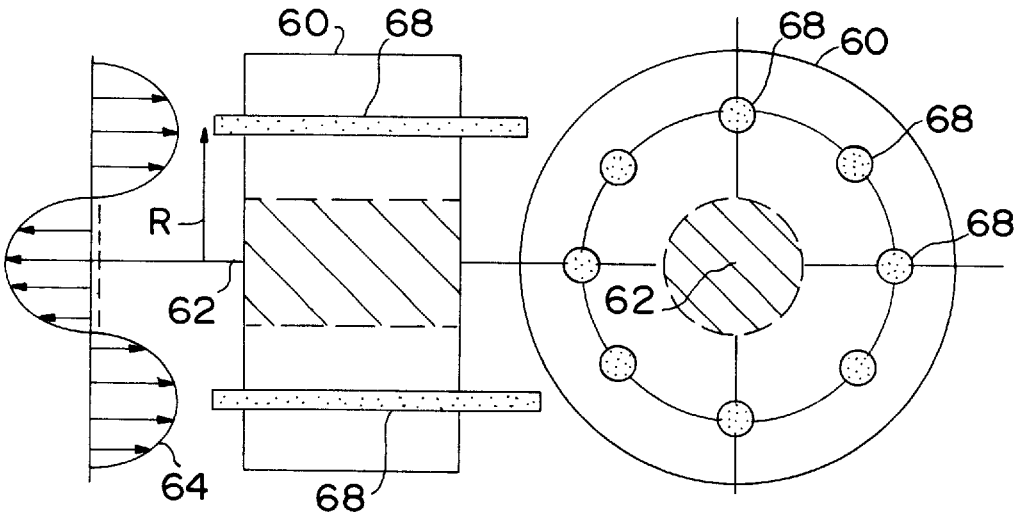
FIGS. 3A and 3B are schematic axial and transverse cross sections, respectively, of a coaxial accelerating cavity for acceleration of multiple beams or a hollow beam in accordance with the present invention.
FIG. 3C is a graph of axial electric field as a function of radius in the accelerating cavity of FIGS. 3A and 3B.

An accelerating cavity 60 for use in the accelerator structure of the present invention is shown schematically in FIGS. 3A and 3B. The accelerating cavity 60 has a circular cross-section with a central axis 62. The cavity 60 is configured to operate in the $TM_{020}$ transverse magnetic mode, with two field variations in the radial direction, as indicated by axial field distribution 64 shown in FIG. 3C. The cavity or cell could also be coaxial with a cylindrical conductor in the central region. More particularly, the field distribution 64 has a circular maximum at a radius R in the cavity 60. The accelerating cavity 60 is designed for accelerating a substantially uniform hollow beam or two or more discrete beams. Multiple discrete beams 68 are shown in FIG. 3. The hollow beam or the discrete beams are positioned at a distance R from central axis 62, corresponding to the maximum in the axial field distribution 64. As a result, the particles in the beam are accelerated in the axial direction.

The accelerating cavity can include a continuous annular aperture, or passageway, or a series of discrete apertures for the charged particle beam or beams. When discrete apertures are used, the apertures are distributed on a circle of radius R. In each case, the aperture is located at a distance R from central axis 62. The approximate beam current increase as compared with prior art accelerator structures is estimated as K=3.1415 R/a, where R is the radius of the annular aperture and a is the aperture dimension. In essence, the maximum beam current that is obtained from the instant accelerator is generally in the range of as much as 10 to 20 times greater than is present in prior art devices.

Figure 4:
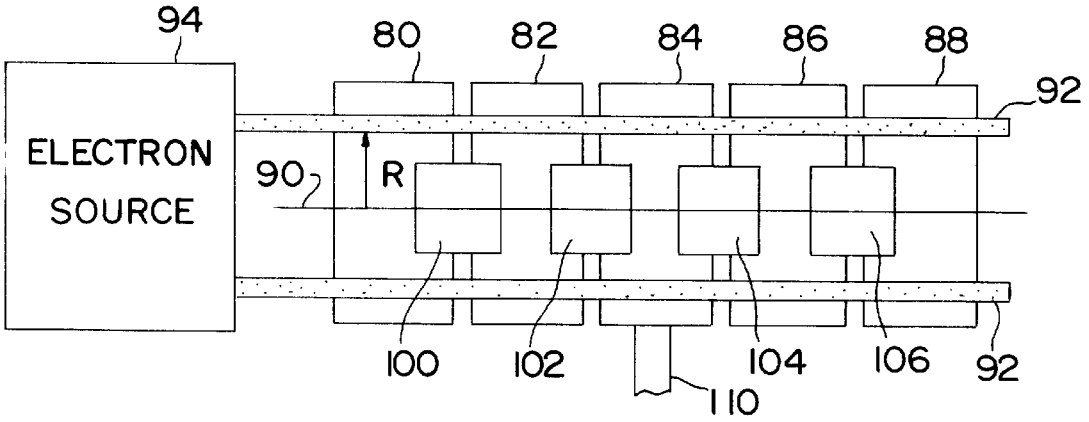
FIG. 4 is a schematic diagram of an accelerator in accordance with the present invention using on-axis coupling between adjacent accelerating cavities.

A schematic diagram of a charged particle beam accelerator in accordance with the present invention is shown in FIG. 4. Accelerating cavities 80, 82, 84, 86 and 88 are disposed in a linear arrangement along a central axis 90. Each of the accelerating cavities 80, 82, 84, 86 and 88 is configured as described above in connection with FIG. 3A–3C. That is, each accelerating cavity has an annular passageway configuration comprising a continuous annular aperture or two or more discrete apertures at a prescribed radius R from central axis 90. An annular beam 92 passes through the annular passageway configuration. The annular beam 92 generated by a charged particle beam source, such as a charged particle source 94, can comprise a substantially uniform hollow beam or two or more discrete beams. The annular beam 92 is parallel to central axis 90 and is spaced from axis 90 by radius R. Each of the accelerating cavities is structured to produce a field distribution having a maximum at a radius R corresponding to the radius of the annular passageway configuration. As noted above, the accelerating cavity can be configured for operation in the transverse magnetic $TM_{020}$ mode or be a coaxial-cavity type structure.

The accelerator shown in FIG. 4 requires coupling circuits for coupling microwave energy between adjacent accelerating cavities. The coupling circuits can comprise off-axis $TM_{010}$ cavities. However, in a preferred embodiment, coupling circuits 100, 102, 104 and 106 are located on central axis 90. Each coupling circuit couples microwave energy between adjacent accelerating cavities. For example, coupling circuit 100 couples microwave energy between accelerating cavities 80 and 82. The coupling circuits can, for example, comprise magnetically or electrically coupled $TM_{010}$ type resonators and provide 90_phase shift per cell. The coupling circuits 100, 102, 104 and 106 are removed from the charged particle beam so that they do not reduce the shunt impedance of the structure. At the same time, the coupling circuits do not require an increase in the outside diameter of the structure and keep the structure axially symmetrical. The latter is important for cavity manufacturing, tuning and handling.

The accelerator shown in FIG. 4 is a standing wave structure. Microwave energy may be coupled to the structure through a sidewall of one of the accelerating cavities, as indicated schematically by input waveguide 110 in FIG. 4. The structure is typically designed for operation through a broad frequency range such as from 200 MHz through 100 GHz. It will be understood that the accelerator can utilize more or fewer accelerating cavities than shown in FIG. 4, depending on the required accelerating energy of the charged particle beam. The coupling coefficients of the coupling circuits 100, 102, 104 and 106 can be made of a very high value to reduce the filling time of the structure and increase group velocity in the structure. When the structure is electrically coupled, it resembles a disk-loaded waveguide, with every next cavity or next few cavities in $TM_{020}$ mode. Electrical or magnetic coupling can be utilized in this design while maintaining the required phase shift and maximum shunt impedance.

In some applications of a charged particle beam, the beam must be distributed over a specified area. This may be accomplished by microwave, magnetic or electrical beam scanning in one or two dimensions, as known in the art. The accelerator shown in FIG. 4 provides an output beam that is distributed in an annular configuration. Thus, in some cases it is possible to eliminate the requirement for scanning of the charged particle beam. Furthermore, the aperture configuration of the accelerator can be designed to provide a desired spatial distribution of the charged particle beam. For example, the aperture can comprise a continuous annular aperture, and the beam can comprise a uniform hollow beam or a series of discrete beams that pass through the continuous annular aperture. Alternatively, the accelerator structure can be configured with two or more discrete apertures at a radius R from the central axis 90. The apertures can be circular or arc-shaped and can have any desired distribution along the circumference of a circle of radius R.

Figure 5:
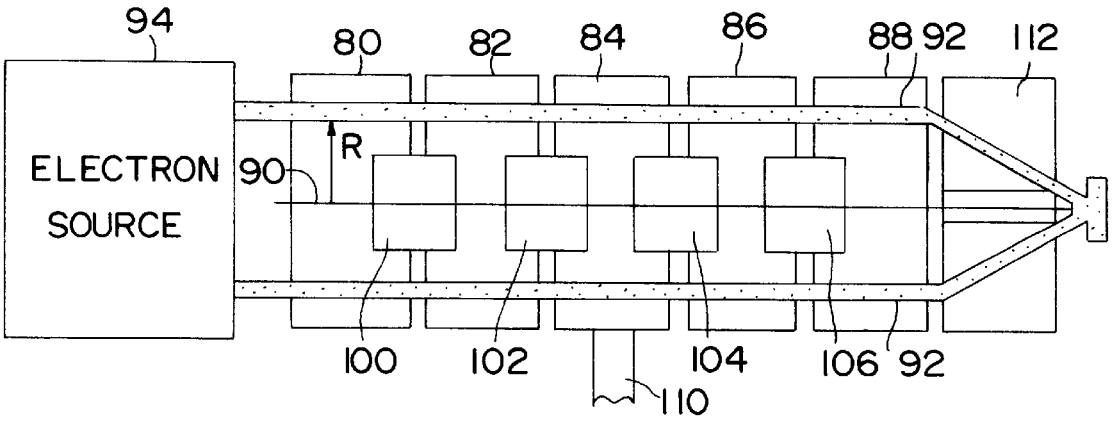
FIG. 5 is a schematic diagram of an accelerator in accordance with the present invention having a focusing device for focusing the output beams at a desired location.

In other applications, it is necessary to provide a single, small size charged particle beam. For example, x-rays generated by electrons colliding with a heavy metal target are widely used, particularly for nondestructive testing. For this application, the accelerator shown in FIG. 4 can be modified as shown in FIG. 5 to add a focusing device 112 at the output end of the structure. The focusing device 112 focuses the hollow beam or the discrete beams into one single spot. The focusing device 112 can, for example, comprise one or more transverse field coaxial type resonant cavities. The focusing device 112 can be coupled to the rest of the accelerator structure directly or through a phase shifting element and/or a power regulator to maintain or regulate the spot size and/or the focusing distance. The beam can also be swept to form a uniformly distributed electron density on a target. This can be accomplished by regulating the phase shift between the main accelerator structure and the focusing device 112 with deflecting radial fields.

Figure 6A:
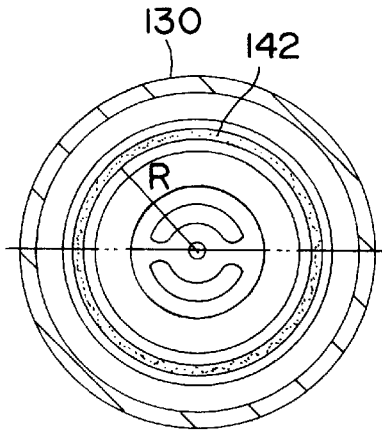
FIGS. 6A and 6B are transverse and axial cross-sections, respectively, of an accelerator in accordance with the present invention having magnetic coupling between accelerating cavities through on-axis coupling cavities.
Figure 6B:
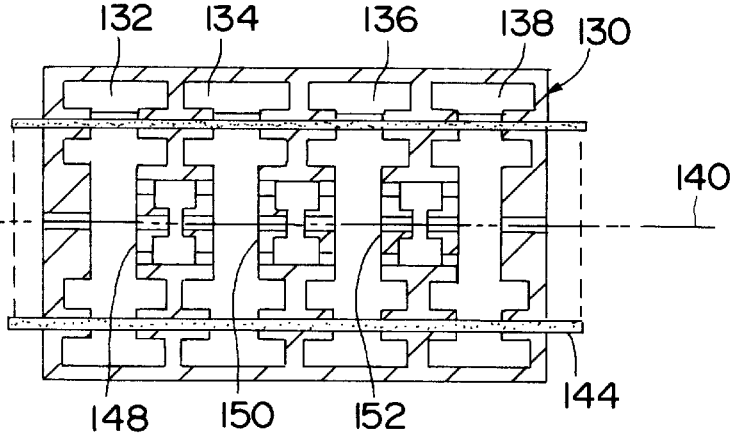

A first example of a microwave accelerator in accordance with the present invention is shown in FIGS. 6A and 6B. A conductive accelerator housing 130 defines accelerating cavities 132, 134, 136 and 138 in a linear arrangement along a central axis 140. The accelerator housing 130 defines a continuous annular aperture 142 through each accelerating cavity. The annular aperture 142 has a radius R, and the axial electric field distribution within each cavity is designed to have the maximum at radius R, such that charged particles passing through annular aperture 142 are accelerated by the electric field. The accelerator housing 130 which defines annular aperture 142 extends in an axial direction into each of the accelerating cavities so that the charged particles are shielded from the microwave fields during the portion of the standing wave that is reversing phase. Thus, the charged particles are exposed in the central portion of each accelerating cavity to accelerating fields. Coupling circuits 148, 150 and 152 are located on axis 140 and couple microwave energy between adjacent accelerating cavities. Thus, coupling circuit 148 couples microwave energy between accelerating cavities 132 and 134; coupling circuit 150 couples microwave energy between accelerating cavities 134 and 136; and coupling circuit 152 couples microwave energy between accelerating cavities 136 and 138. The embodiment of FIGS. 6A and 6B utilizes on-axis magnetic coupling circuits.

Figure 7A:
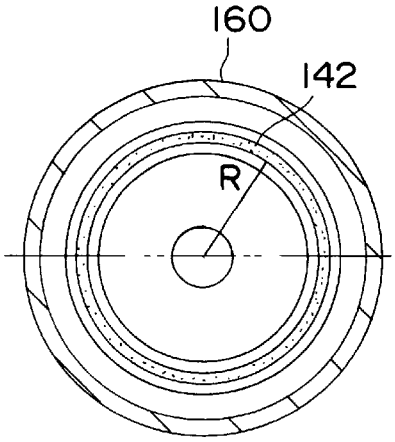
FIG. 7A and 7B are transverse and axial cross-sections, respectively, of an accelerator in accordance with the present invention having on-axis electrical coupling between accelerating cavities.
Figure 7B:
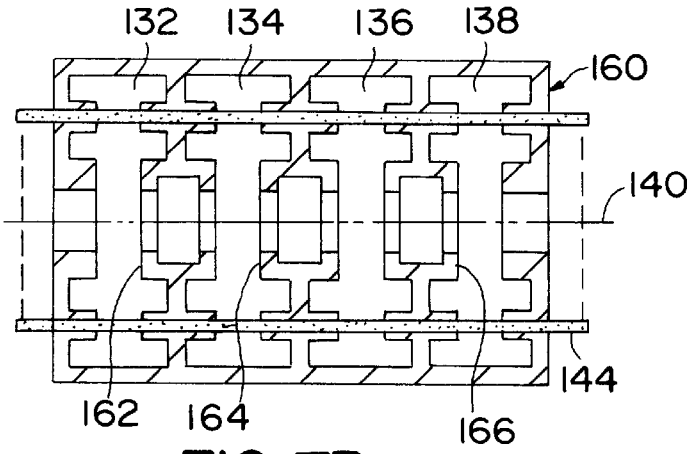

A second example of a microwave accelerator in accordance with the present invention is shown in FIGS. 7A and 7B. The accelerator structure of FIGS. 7A and 7B is similar to the accelerator structure of FIGS. 6A and 6B, but uses different coupling circuits. An accelerator housing 160 defines accelerating cavities 132, 134, 136 and 138, and further defines annular aperture 142. Coupling circuits 162, 164 and 166 couple microwave energy between adjacent accelerating cavities. In the embodiment of FIGS. 7A and 7B, the coupling circuits 162, 164 and 166 comprise on-axis electrical coupling circuits.

As indicated previously, the annular aperture 142 can have a continuous configuration, thus defining a ring-shaped aperture. Alternatively, the annular aperture 142 can be configured as two or more discrete apertures, which may be arc-shaped or circular. The beam 144 may have a uniform hollow configuration or may comprise two or more discrete beams. A variety of coupling circuits for coupling microwave energy between adjacent accelerating cavities may be used within the scope of the present invention.

Figure 8:
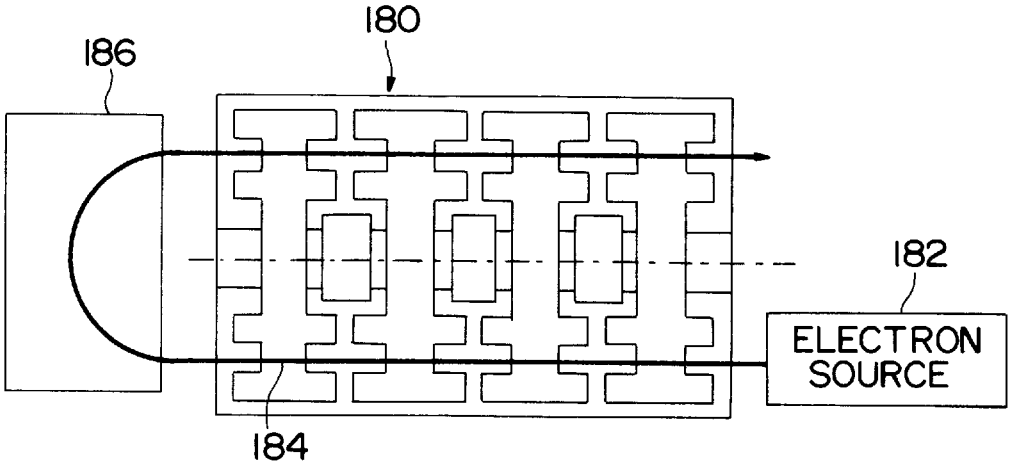
FIG. 8 illustrates an accelerator in accordance with the present invention in a multiple pass configuration.

Another aspect of the invention is described with reference to FIG. 8. The accelerator structure described above can be used in a multiple pass configuration wherein the charged particle beam passes through the accelerator structure two or more times to achieve high accelerating energies. A configuration wherein the charged particle beam passes through the accelerator structure twice is illustrated in FIG. 8. An accelerator structure 180 corresponds, for example, to the accelerator structure shown in FIGS. 7A and 7B and described above. A charged particle beam source, such as electron source 182, directs an charged particle beam 184 through the accelerator structure. The beam 184 is directed either through one of the discrete apertures or through a portion of a continuous annular aperture. A beam bending device 186 is positioned at the end of accelerator structure 180 opposite electron source 182. The bending device 186 may, for example, comprise a bending magnet. The bending device 186 is designed to reverse the direction of beam 184 and to direct it through the annular aperture of accelerator structure 180 in the opposite direction from the first pass and along a different path from the first pass, so that the beam is further accelerated. Thus, the accelerator structure 180 can be used to produce high energy gain in a compact, multipass configuration. It will be understood that the beam 184 can be reversed one or more additional times to cause additional passes through the accelerator structure. A bending device produces each beam reversal.

The energy increase at the same value of dissipated power is proportional to $N^{1/2}$, where N is the number of beam passes, assuming that the structure volume grows proportionally to N. Therefore, with four passes the energy gain is doubled; and with sixteen passes the energy gain is four times. A microwave beam bending device, such as a C-shaped resonance or traveling wave cavity with transverse E-field components which interact with the beam, can be used as an alternative to the bending magnet or electrostatic bending device.

Figure 9:
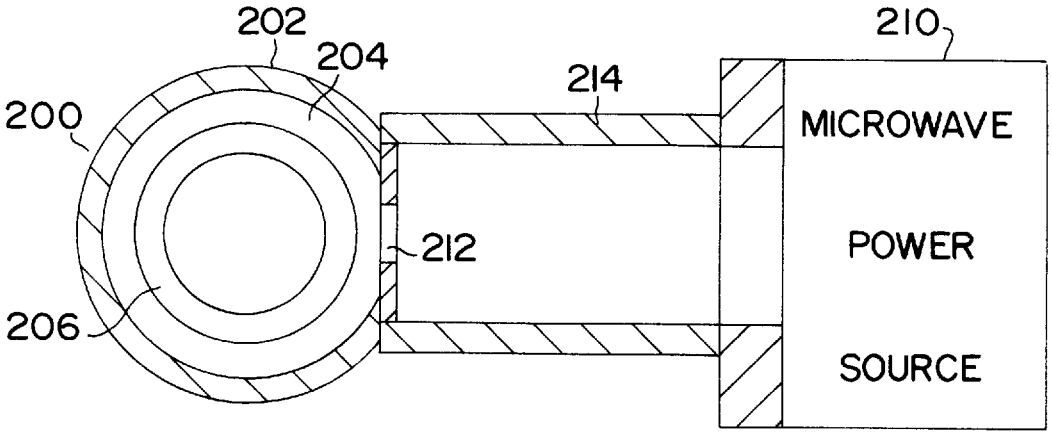
FIG. 9 is a schematic cross-sectional view of an accelerator, illustrating coupling of microwave power into the accelerator in accordance with the present invention.

An example of a suitable configuration for coupling microwave energy into the accelerator of the present invention is shown in FIG. 9. An accelerator 200 is shown in transverse cross section. Accelerator housing 202 defines an accelerating cavity 204 having an annular aperture 206. Microwave power from a microwave power source 210 is coupled through an iris 212 in a waveguide 214 into accelerating cavity 204 through the sidewall of housing 202. Since the accelerator is a resonant structure, the microwave power may be coupled into any desired accelerating cavity of the accelerator.

Figure 10:
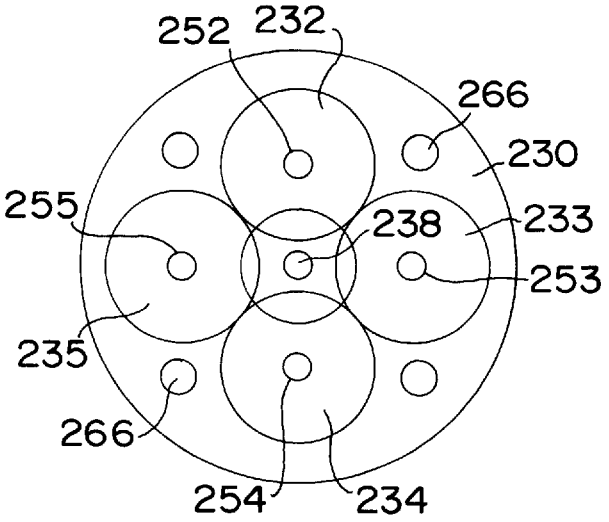
FIG. 10 is a schematic lateral cross-section of an accelerator wherein accelerating cavities spaced from a central axis are coupled through a set of axial coupling cavities.
Figure 11:
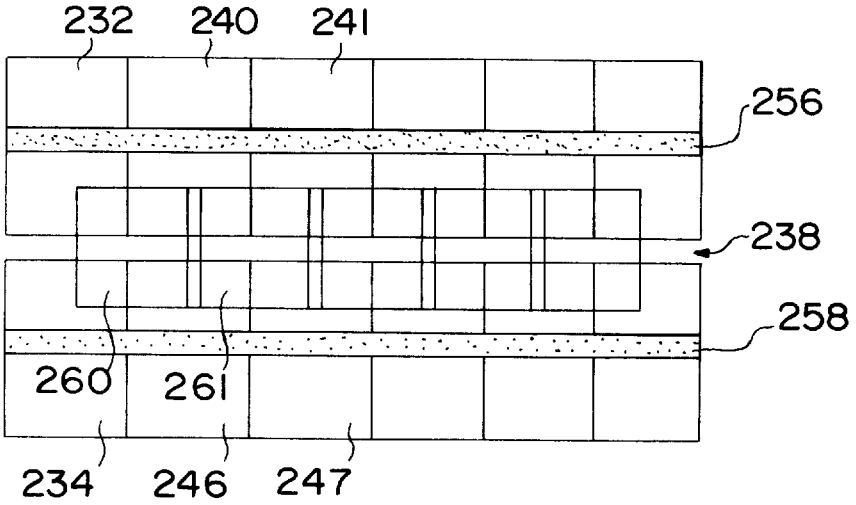
FIG. 11 is a schematic axial cross section of the accelerator of FIG. 10.

A further embodiment of the present invention, which utilizes parallel accelerating cavities, is shown in FIGS. 10 and 11. An accelerator housing 230 defines accelerating cavities 232, 233, 234 and 235 positioned around a central axis 238, as shown in FIG. 10. The parallel accelerating cavities 232, 233, 234 and 235 form an accelerating stage. The configuration of accelerating cavities shown in FIG. 10 is repeated along axis 238 in a linear arrangement, as shown in FIG. 11. Thus, for example, accelerating cavities 240, 241, etc. are axially aligned with accelerating cavity 232, and accelerating cavities 246, 247 etc. are axially aligned with accelerating cavity 234. Accelerating cavities 232, 233, 234 and 235 have central apertures 252, 253, 254 and 255, respectively, for passage of charged particle beams in an axial direction. Charged particle beams 256 and 258 are shown in FIG. 11. The central apertures 252, 253, 254 and 255 are equally spaced from central axis 238. Each accelerating cavity is configured to produce a maximum axial electric field at its central aperture.

Each group of four accelerating cavities, such as accelerating cavities 232, 233, 234 and 235, is coupled to the next group of four accelerating cavities along axis 238 by a coupling circuit. Coupling circuits 260, 261 etc. are shown in FIG. 11. The coupling cavities are preferably located on axis 238. The accelerator housing may include cooling channels 266.

Figure 1:
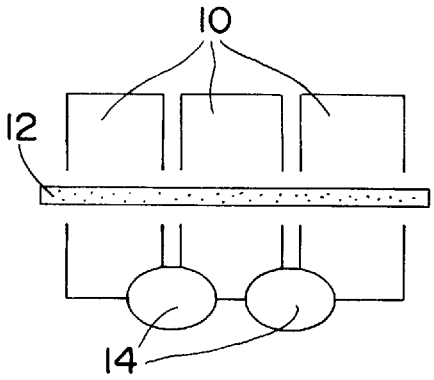
FIG. 1 PRIOR ART
FIG. 1 is a schematic diagram of a prior art accelerator with off-axis coupling between accelerating cavities.
Figure 2:
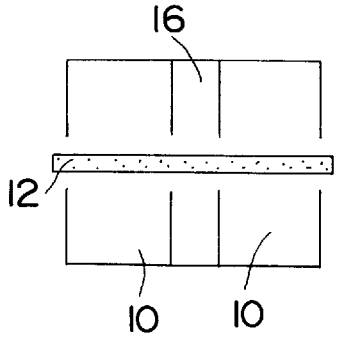
FIG.2 PRIOR ART
FIG. 2 is a schematic diagram of a prior art accelerator with on-axis coupling between accelerating cavities.

The accelerator shown in FIGS. 10 and 11 operates in a manner similar to the accelerators shown and described above. The large cross sectional volume of the charged particle beam passing through the apertures 252, 253, 254 and 255 permits a high current, high energy beam to be generated. The accelerator shown in FIGS. 10 and 11 may be used in a multiple pass configuration as described above in connection with FIG. 8. Assuming that accelerator volume is increased N times compared to an accelerator as shown in FIG. 2, it can be predicted that the energy gain in the case of multiple pass operation is $N^{1/2}$ with no beam loading. In the case of N-beam loading, the beam current is increased N times with $N^{1/2}$ reduced maximum unloaded energy in the structure. The configuration shown in FIG. 10 includes four accelerating cavities disposed around central axis 38. It will be understood that the parallel accelerator structure may include any number of accelerating cavities greater than one disposed around the central axis.

Figure 12:
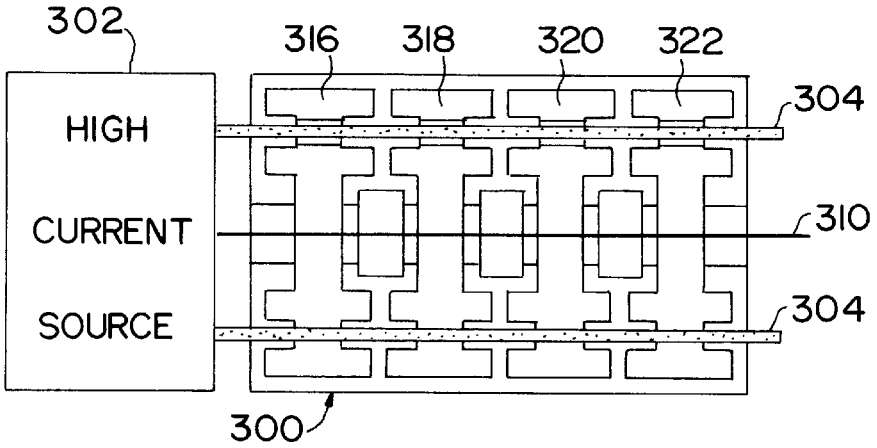
FIG. 12 is a schematic diagram that illustrates use of the accelerator of the present invention in a beam excited configuration.

According to another aspect of the present invention, the accelerator structures shown and described above may be used in a beam excited configuration. An example of a beam excited configuration is shown in FIG. 12. An accelerator 300 corresponds to the accelerator shown in FIG. 7 and described above. A source 302 of charged particles supplies a relatively high current, low energy beam 304 through apertures spaced from central axis 310. The high current beam 304 is bunched at the microwave frequency of operation of the accelerator structure and typically has an energy in the range of tens to hundreds of kilovolts. The source 302 may, for example, include an electron source followed by a bunching cavity. The high current beam 304 excites microwave fields within accelerating cavities 316, 318, 320, 322 of accelerator 300. The microwave fields transfer energy to a relatively low current, high energy charged particle beam on axis 310. In this configuration, a high gradient axial accelerating field in the accelerating cavities is excited by the high current beam 304 passing through the off-axis apertures of the accelerator. The high current beam 304 excites $TM_{02}N$ fields so that it creates a variation of the accelerating field on axis 310. This field is used to accelerate the beam on axis 310 to high energy. In the configuration of FIG. 12, only a microwave power source of low power is required.

Figure 13:
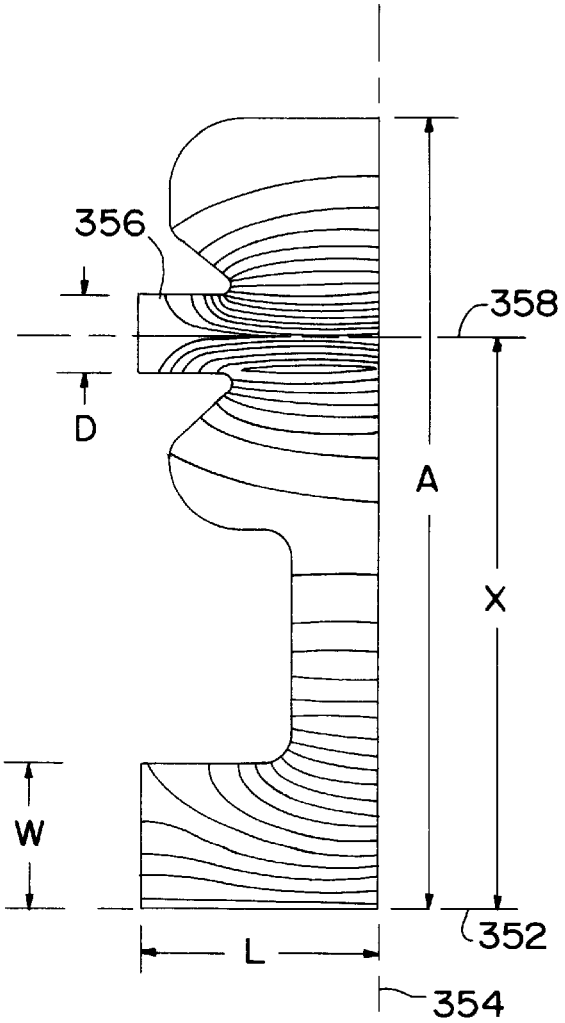
FIG. 13 illustrates an example of a "superfish" design of a single accelerating cavity.

An example of an accelerating cavity design in accordance with the invention is described with reference to FIG. 13. One quarter of the accelerating cavity is illustrated in FIG. 13. Accelerating cavity 350 is symmetric with respect to central axis 352 and is symmetric with respect to transverse plane 354. Thus, one quarter of a full accelerating cavity is represented by accelerating cavity 350 in FIG. 13. Accelerating cavity 350 in this example is designed for operation in X band at 9300 Megahertz. In this example, the radius A of the accelerating cavity is 1.1 inches, the length L along axis 352 is 0.3171 inch and the on-axis hole has a radius W of 0.204 inch. The axis 358 of aperture 356 is at a distance X of 0.8 inch from central axis 352, and the aperture 356 has a diameter D of 0.3 inch. The accelerating cavity 350 operates in the $TM_{020}$ mode and utilizes on-axis electrical coupling.

Figure 14A:
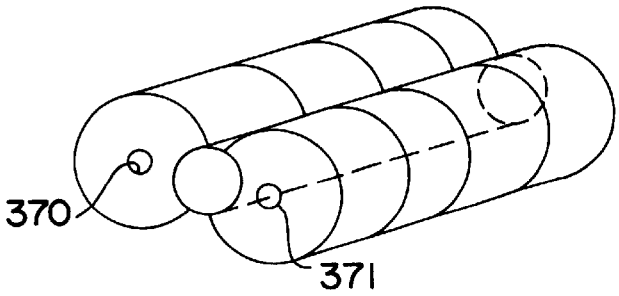
FIG. 14A and 14B illustrate a dual beam system capable of stereo imaging in accordance with the present invention.
Figure 14B:
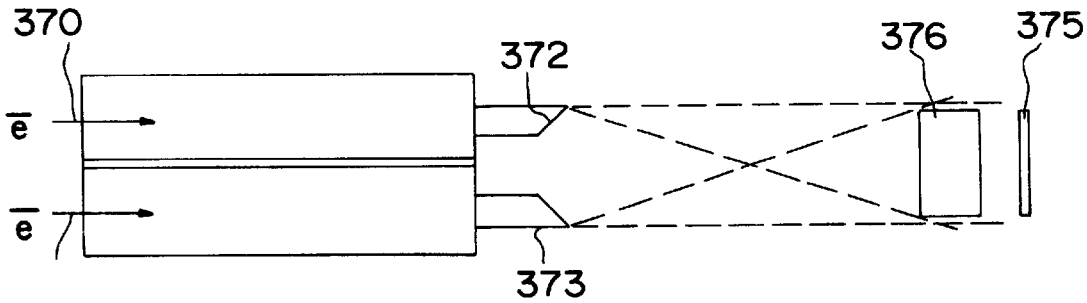

Shown in FIG. 14A and 14B is a dual beam system stereo imaging accelerator in accordance with the present invention. Two separate beams 370 and 371 are used with two separate targets 372 and 373 respectively, which are positioned in a relationship with one another as to create a stereo image at detector 375 positioned next in the beams pats following the object 376 to be examined.

Figure 15:
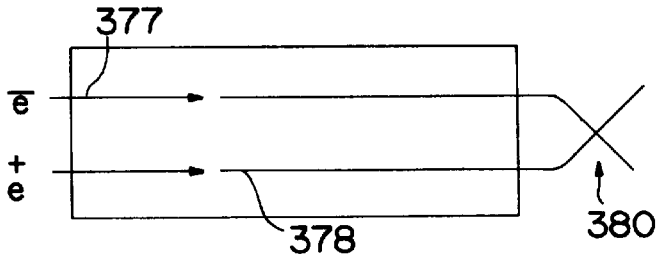
FIG. 15 is a schematic showing of a collider also in accordance with the present invention; and, FIG. 16 shows, in schematic form, an amplifying structure in accordance with the present invention.

Another application for this invention is illustrated in FIG.15 where electrons are accelerated in one channel 377 and positrons are accelerated in close by parallel channel 378 and these beams intersect or collide at a point of interaction 380. Instead of electrons and positron, ions of negative and of positive charge may be used.

Figure 16:
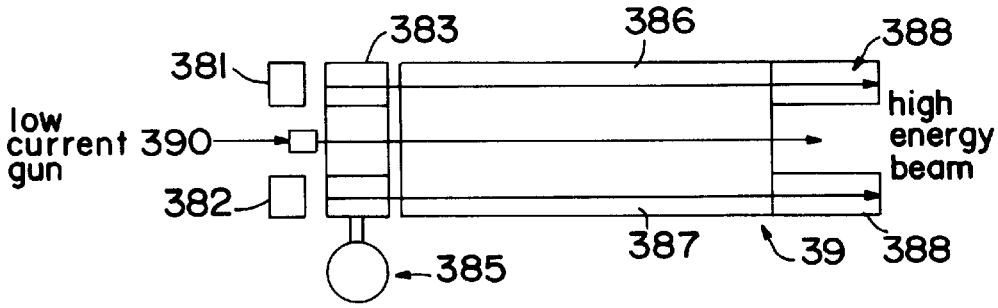

In FIG. 16 an amplifying structure is illustrated in which high current guns 381 and 382 release high current beams which pass through a prebuncher 383 fed by low power microwave source 385 and pass into cavities 386 and 387 to beam dumps 388. These high current beams excite microwave fields in the cavities and a low current beam issuing from low current gun 390 is accelerated to high energy. This amplifier 391 may be used in a collider or as a commercial accelerator.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A linear accelerator for charged particles, comprising:

a plurality of accelerating cavities disposed in a linear arrangement along a central axis between input and output cavities, all said cavities being directly electromagnetically coupled to each other, each accelerating cavity having a central passageway electromagnetically coupling said cavities to one another at said central axis and having at least one additional passageway radially spaced from the central axis for transmitting a beam of charged particles through said accelerating cavities in energy exchanging relation with an electromagnetic wave passing through said central axis;

means for coupling electromagnetic wave energy to said accelerating cavities to produce an accelerating electric field in a region of the passageway of each of said accelerating cavities; and coupling circuits for coupling said electromagnetic wave energy between adjacent ones of said accelerating cavities along said central axis, said coupling between said adjacent ones of said accelerating cavities along said central axis capable of being either predominantly electric or magnetic field coupled.

2. A linear accelerator as defined in claim 1 wherein said at least one additional passageway comprises two or more spaced-apart apertures, each at a distance R from said central axis, and in which said beam of charged particles in energy exchanging relation with an electromagnetic wave passing through said central axis comprises two or more parallel beams passing through said spaced apart apertures.

3. A linear accelerator as defined in claim 1 wherein said passageway comprises a continuous annular aperture at a radius R from said central axis and said beam of charged particles comprises a hollow beam.

4. A linear accelerator as defined in claim 1 wherein said coupling circuits are spaced from said central axis.

5. A linear accelerator as defined in claim 1 wherein said means for coupling electromagnetic wave energy to said accelerating cavities comprises means for producing a maximum electric field strength at said passageway.

6. A linear accelerator as defined in claim 1 wherein said means for coupling electromagnetic wave energy to said accelerating cavities comprises means for producing a $TM_{020}$ mode in each of said accelerating cavities.

7. A linear accelerator as defined in claim 1 further including means for focusing said beam of charged particles at a desired location.

8. A linear accelerator as defined in claim 1 further including a beam bending device positioned at one end of said passageway for reversing the beam exiting said passageway and directing it through said passageway a second time along a different path, whereby said beam makes at least two passes through said accelerating cavities.

9. A linear accelerator as defined in claim 1 wherein said beam of charged particles comprises an electron beam.

10. A linear accelerator as defined in claim 9 wherein said at least one additional passageway comprises two or more spaced-apart apertures, each at a distance R from said central axis, and in which said beam of charged particles in energy exchanging relation with an electromagnetic wave passing through said central axis comprises two or more parallel beams passing through said spaced apart apertures.

11. A linear accelerator as defined in claim 10 wherein said passageway comprises a continuous annular aperture at a radius R from said central axis and said beam of charged particles comprises a hollow beam.

12. A linear accelerator for charged particles, comprising:

a plurality of accelerating cavities disposed in a linear arrangement along a central axis between input and output cavities, all said cavities being directly coupled to each other, each accelerating cavity having a first passageway radially spaced from the central axis for transmitting a lower energy accelerating beam of charged particles through said first passageway of said accelerating cavities, each accelerating cavity further including a second passageway for transmitting a higher energy accelerating beam of charged particles, said cavities for said first passageway and for said second passageway, each being spaced so that said lower and said higher energy beams passing therethrough are in phase between cavities when transmitting r.f. power;

coupling circuits for coupling electromagnetic wave energy between adjacent ones of said accelerating cavities, said coupling between said adjacent ones of said accelerating cavities capable of being either predominantly electric or magnetic field coupling; and means for coupling said accelerating beam of charged particles through said first passageway of said accelerating cavities for producing an accelerating electric field and simultaneously producing an accelerating electric field in said second passageway of each of said accelerating cavities for accelerating said higher energy beam of charged particles therethrough.

13. A linear accelerator for charged particles, comprising;

a plurality of accelerating cavities disposed in a linear arrangement along a central axis between input and output cavities, all said cavities being directly electromagnetically coupled to each other, each accelerating cavity having two or more discrete apertures at a predetermined radius from said central axis for transmitting two or more beams of charged particles through said accelerating cavity in energy exchanging relation with an electromagnetic wave in said accelerating cavity;

means for coupling electromagnetic wave energy to said accelerating cavities to produce an accelerating electric field in a region of each of said discrete apertures of each said accelerating cavity; and coupling circuits for coupling said electromagnetic wave energy between adjacent ones of said accelerating cavities along said central axis.

14. A linear accelerator as defined in claim 13 further including a beam bending device positioned at one end of said plurality of accelerating cavities for reversing the beam exiting said accelerating cavities and directing it through said plurality of accelerating cavities a second time, said beam makes at least two passes through said accelerating cavities.

15. A linear accelerator for charged particles comprising;

a plurality of accelerating cavities disposed in a linear arrangement along a central axis, each accelerating cavity having a continuous annular aperture at a radius R from said central axis for transmitting a hollow beam of charged particles through said accelerating cavity in energy exchanging relation with an electromagnetic wave in said accelerating cavity;

an opening at the central axis of said cavities for coupling an electromagnetic wave through the accelerator, means for coupling electromagnetic wave energy to said accelerating cavities to produce an accelerating electric field in a region of the continuous annular aperture of each of said accelerating cavities; and RF coupling circuits for coupling said electromagnetic wave energy between adjacent ones of said accelerating cavities.

16. A linear accelerator as defined in claim 15 further including a beam bending device positioned at one end of said aperture for reversing the beam exiting said aperture and directing it through said aperture a second time along a different path, whereby said beam makes at least two passes through said accelerating cavities.

17. A linear accelerator for charged particles, comprising:

a plurality of accelerating cavities disposed in a linear arrangement along a central axis, each accelerating cavity having at least one passageway radially spaced from the central axis for transmitting a beam of charged particles through said accelerating cavity in energy exchanging relation with an electromagnetic wave in said accelerating cavity;

means for coupling electromagnetic wave energy to said accelerating cavities to produce an accelerating electric field in a region of the passageway of each of said accelerating cavities;

coupling circuits for coupling said electromagnetic wave energy between adjacent ones of said accelerating cavities; and a beam bending device positioned at one end of said passageway for reversing the beam exiting said passageway and directing it through another and second passageway through said accelerating cavities increasing its energy as it passes therethrough, said cavities for said first and for said second passageways being spaced so that the beams passing through said first passageway and through said second passageway are in phase between cavities when transmitting r.f. power and whereby said beam makes at least two passes through said accelerating cavities.

* * * * *